US012655603B2

(12) United States Patent
Suzuki et al.

(10) Patent No.: US 12,655,603 B2
(45) Date of Patent: Jun. 16, 2026

(54) SYSTEM, METHOD, AND PROGRAM FOR CONTROLLING WORK MACHINE

(71) Applicant: Komatsu Ltd., Tokyo (JP)

(72) Inventors: Hikaru Suzuki, Tokyo (JP); Tsutomu Iwamura, Tokyo (JP); Sho Nozaki, Tokyo (JP); Ryuji Kanda, Tokyo (JP); Daishi Iwanaga, Tokyo (JP); Tomokazu Hirao, Tokyo (JP); Yuta Uchida, Tokyo (JP); Yuki Shimano, Tokyo (JP); Jun Sasaki, Tokyo (JP); Jin Kitajima, Tokyo (JP)

(73) Assignee: Komatsu Ltd., Tokyo (JP)

( * ) Notice: Subject to any disclaimer, the term of this patent is extended or adjusted under 35 U.S.C. 154(b) by 93 days.

(21) Appl. No.: 18/684,253

(22) PCT Filed: Sep. 29, 2022

(86) PCT No.: PCT/JP2022/036540

§ 371 (c)(1),
(2) Date: Jul. 17, 2024

(87) PCT Pub. No.: WO2023/054623

PCT Pub. Date: Apr. 6, 2023

(65) Prior Publication Data

US 2025/0270786 A1 Aug. 28, 2025

(30) Foreign Application Priority Data

Sep. 30, 2021 (JP) ..... 2021-161745

(51) Int. Cl.
*E02F 9/26* (2006.01)
*E02F 3/36* (2006.01)
(Continued)

(52) U.S. Cl.
CPC ..... *E02F 3/435* (2013.01); *E02F 3/3681* (2013.01); *E02F 9/265* (2013.01); *E02F 3/32* (2013.01); *E02F 9/2203* (2013.01)

(58) Field of Classification Search
CPC ... E02F 9/26; E02F 9/264; E02F 9/265; E02F 9/261; E02F 9/262; E02F 9/267;
(Continued)

(56) References Cited

U.S. PATENT DOCUMENTS

| | | | | |
|---|---|---|---|---|
| 9,995,017 | B1 * | 6/2018 | Howell | E02F 9/2025 |
| 10,738,439 | B2 * | 8/2020 | Mairet | E02F 3/432 |
| 2009/0162177 | A1 * | 6/2009 | Nichols | E02F 3/431 172/4.5 |
| 2013/0158788 | A1 * | 6/2013 | Seki | E02F 9/261 701/34.4 |

(Continued)

FOREIGN PATENT DOCUMENTS

| | | | | |
|---|---|---|---|---|
| CN | 113167052 | A | 7/2021 | |
| EP | 3184699 | A1 * | 6/2017 | E02F 3/3663 |

(Continued)

*Primary Examiner* — Ramya P Burgess
*Assistant Examiner* — Sara J Lewandroski
(74) *Attorney, Agent, or Firm* — Fish & Richardson P.C.

(57) ABSTRACT

A measured value acquisition unit acquires measured values from a plurality of sensors. A position and posture calculation unit calculates a current posture of the work tool, based on the measured values. A target posture determination unit determines a virtual rotation axis, based on the calculated current posture of the work tool. A rotation amount calculation unit generates a control signal of the tilt rotator for rotating the work tool around the virtual rotation axis, based on the operation signal from an operation device. A control signal output unit outputs the generated control signal.

5 Claims, 7 Drawing Sheets

(51) Int. Cl.
*E02F 3/43* (2006.01)
*E02F 3/32* (2006.01)
*E02F 9/22* (2006.01)

(58) Field of Classification Search
CPC ..... E02F 9/268; E02F 9/2037; E02F 3/3677; E02F 3/3681; E02F 3/43; E02F 3/431; E02F 3/432; E02F 3/433; E02F 3/434; E02F 3/435; E02F 3/436; E02F 3/437; E02F 3/438; E02F 3/439; E02F 3/844; E02F 3/845; E02F 3/16; E02F 3/815; E02F 3/8152; E02F 3/84; E02F 3/847; E02F 3/76; E02F 3/7609; E02F 3/7613; E02F 3/7618; E02F 3/7627; E02F 3/7631; E02F 3/7636; E02F 3/764; E02F 3/7645; E02F 3/765; E02F 3/7654; E02F 3/7659; E02F 3/7663; E02F 3/7668; E02F 3/7672; E02F 3/7677; E02F 3/7681; E02F 3/7686; E02F 5/145
See application file for complete search history.

(56) References Cited

U.S. PATENT DOCUMENTS

| | | | | |
|---|---|---|---|---|
| 2016/0312434 | A1* | 10/2016 | Shintani | E02F 3/3681 |
| 2016/0319511 | A1* | 11/2016 | Chang | E02F 3/844 |
| 2018/0016768 | A1* | 1/2018 | Izumikawa | E02F 3/439 |
| 2020/0318316 | A1* | 10/2020 | Kjaergaard | E02F 9/2037 |
| 2020/0378794 | A1* | 12/2020 | Yoda | E02F 9/264 |
| 2021/0293000 | A1* | 9/2021 | Currier | E02F 9/24 |
| 2022/0106773 | A1 | 4/2022 | Iwasaki | |
| 2022/0349148 | A1* | 11/2022 | Kumbhar | E02F 3/3414 |
| 2022/0364334 | A1* | 11/2022 | Nicholls | E02F 9/264 |

FOREIGN PATENT DOCUMENTS

| | | | | |
|---|---|---|---|---|
| EP | 3358087 | A1 * | 8/2018 | E02F 9/2012 |
| JP | 2019-173558 | A | 10/2019 | |
| JP | 2020-125599 | A | 8/2020 | |
| WO | WO 2015/193546 | A2 | 12/2015 | |

* cited by examiner

SYSTEM, METHOD, AND PROGRAM FOR CONTROLLING WORK MACHINE

CROSS-REFERENCE TO RELATED APPLICATIONS

This application is a National Stage application under 35 U.S.C. § 371 of International Application No. PCT/JP2022/036540, filed on Sep. 29, 2022, which claims priority to Japanese Patent Application No. 2021-161745, filed on Sep. 30, 2021. The contents of the prior applications are incorporated herein in their entirety.

TECHNICAL FIELD

The present disclosure relates to a system, a method, and a program for controlling a work machine.

BACKGROUND ART

Patent Literature 1 discloses a control system for a construction machine (work machine) including a tilt-rotatable tilt bucket. As described above, a work machine is known, which is equipped with a plurality of rotation mechanisms rotatable around different axes from each other and can rotate a work tool such as a bucket as desired.

CITATION LIST

Patent Literature

[Patent Literature 1]
Japanese Unexamined Patent Application, First Publication No. 2020-125599

SUMMARY OF INVENTION

Technical Problem

Incidentally, a component called a tilt rotator is known which rotatably supports an attachment of a work machine around three mutually orthogonal axes. By attaching the tilt rotator to the work machine, the attachment can be directed in any direction. On the other hand, in a work machine such as a hydraulic excavator, one of the most frequently performed basic operations is an operation (bucket operation) of rotating a bucket along an opening direction of the bucket. The bucket operation is an operation used when performing excavation, dumping, or the like. In a case of a normal hydraulic excavator, such an operation can be easily performed with a simple lever operation. However, in a hydraulic excavator equipped with a tilt rotator, in order to rotate the bucket along an opening direction of the bucket, a compound operation corresponding to the opening direction of the bucket is required.

An object of the present disclosure is to provide a system, a method, and a program capable of simplifying an operation of rotating a work tool along a reference direction of the work tool (for example, an opening direction of a bucket), in a work machine including the work tool supported by work equipment via a tilt rotator.

Solution to Problem

According to an aspect of the present disclosure, there is provided a system for controlling a work machine including a tilt rotator attached to a distal end of the work equipment, and a work tool supported to be rotatable around three axes intersecting with each other in different planes with respect to the work equipment via the tilt rotator, the system including a processor. The processor acquires measured values from a plurality of sensors. The processor calculates a current posture of the work tool based on the measured values. The processor determines a virtual rotation axis, based on the calculated current posture of the work tool. The processor generates a control signal of the tilt rotator for rotating the work tool around the virtual rotation axis, based on the operation signal from the operation device. The processor outputs the generated control signal.

Advantageous Effects of Invention

According to the above aspect, in the work machine including the work tool supported by the work equipment via the tilt rotator, an operation of rotating the work tool along a reference direction (for example, an opening direction of the bucket) can be simplified.

DESCRIPTION OF EMBODIMENTS

First Embodiment

«Configuration of Work Machine»

Hereinafter, an embodiment will be described in detail with reference to the drawings.

Figure 1:
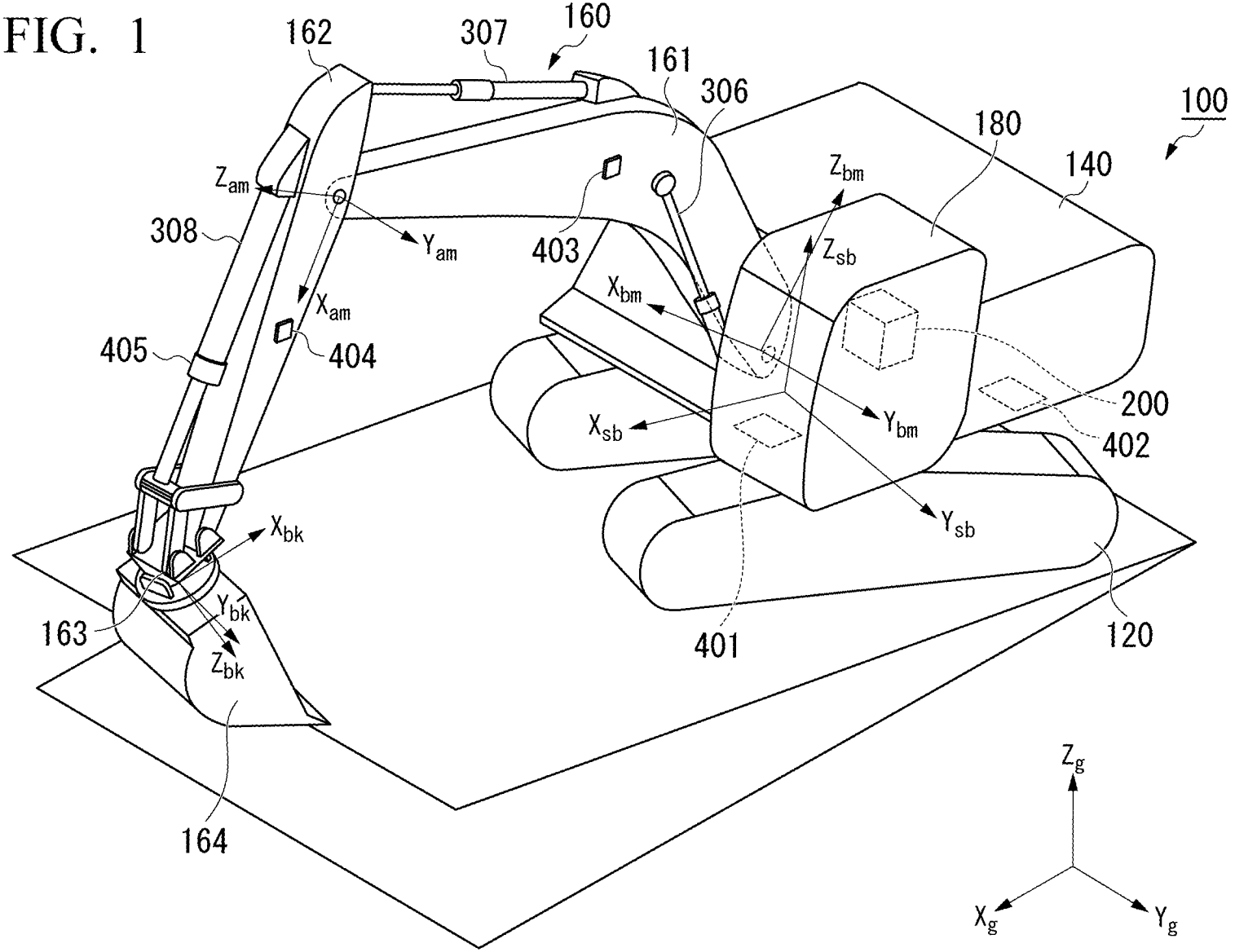
FIG. 1 is a schematic diagram showing a configuration of a work machine 100 according to a first embodiment.

FIG. 1 is a schematic diagram showing a configuration of a work machine 100 according to a first embodiment. The work machine 100 according to the first embodiment is, for example, a hydraulic excavator. The work machine 100 includes an undercarriage 120, a swing body 140, work equipment 160, a cab 180, and a control device 200. The work machine 100 according to the first embodiment is controlled such that the teeth of the bucket 164 do not exceed the design surface.

The undercarriage 120 travelably supports the work machine 100. The undercarriage 120 is, for example, a pair of left and right endless tracks.

The swing body 140 is supported by the undercarriage 120 to be swingable around a swing center.

The work equipment 160 is operably supported by the swing body 140. The work equipment 160 is driven by hydraulic pressure. The work equipment 160 includes a boom 161, an arm 162, a tilt rotator 163, and a bucket 164 that is a work tool. The base end portion of the boom 161 is rotatably attached to the swing body 140. The base end portion of the arm 162 is rotatably attached to the distal end portion of the boom 161. The tilt rotator 163 is rotatably attached to the distal end portion of the arm 162. The bucket 164 is attached to the tilt rotator 163. The bucket 164 is rotatably supported around three axes intersecting with each other on different planes with respect to the work equipment 160 via the tilt rotator 163. Here, a portion of the swing body 140 to which the work equipment 160 is attached is called a front portion. In addition, with respect to the swing body 140, on the basis of the front portion, the opposite portion is referred to as a rear portion, a portion on the left side is referred to as a left portion, and a portion on the right side is referred to as a right portion.

Figure 2:
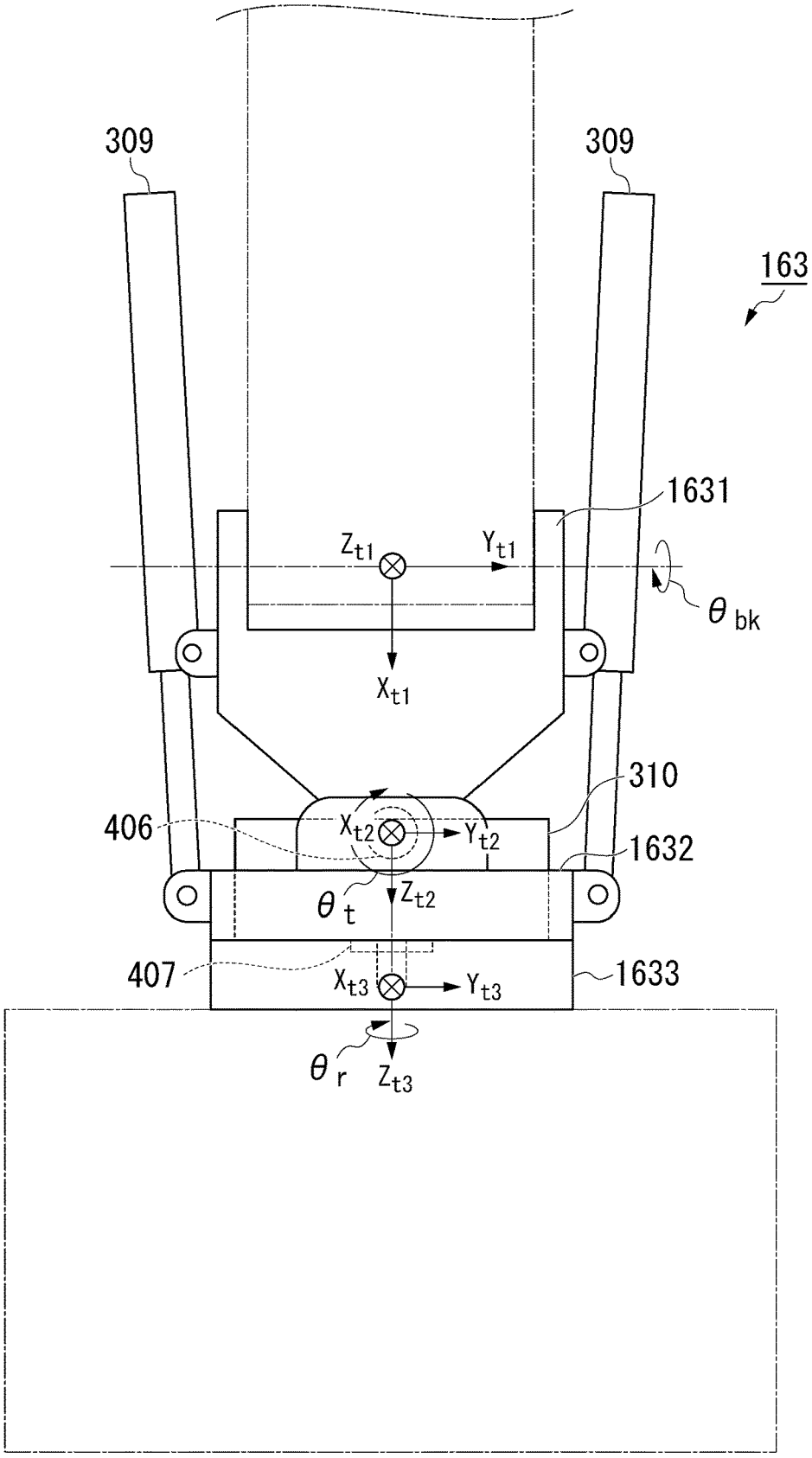
FIG. 2 is a diagram showing a configuration of a tilt rotator 163 according to the first embodiment.

FIG. 2 is a diagram showing a configuration of the tilt rotator 163 according to the first embodiment. The tilt rotator 163 is attached to the distal end of the arm 162 to support the bucket 164. The tilt rotator 163 includes an attachment portion 1631, a tilt portion 1632, and a rotation portion 1633. The attachment portion 1631 is attached to the distal end of the arm 162 so as to be rotatable around an axis extending in the left-right direction in the drawing. The tilt portion 1632 is attached to the attachment portion 1631 to be rotatable around an axis extending in the front-rear direction in the drawing. The rotation portion 1633 is attached to the tilt portion 1632 so as to be rotatable around an axis extending in the up-down direction in the drawing. Ideally, the rotation axes of the attachment portion 1631, the tilt portion 1632, and the rotation portion 1633 are orthogonal to each other. The base end portion of the bucket 164 is fixed to the rotation portion 1633. Accordingly, the bucket 164 can rotate with respect to the arm 162 about three axes orthogonal to each other. However, in reality, there is a possibility that the rotation axes of the attachment portion 1631, the tilt portion 1632, and the rotation portion 1633 include design errors and are not orthogonal to each other.

The cab 180 is provided at the front portion of the swing body 140. An operation device 271 for an operator to operate the work machine 100, and a monitor device 272 which is a man-machine interface of the control device 200 are provided in the cab 180. The operation device 271 receives an input of the operation amount of a traveling motor 304 from an operator, the operation amount of a swing motor 305, the operation amount of a boom cylinder 306, the operation amount of an arm cylinder 307, the operation amount of a bucket cylinder 308, the operation amount of a tilt cylinder 309, and the operation amount of a rotary motor 310. The monitor device 272 receives an input for setting and releasing the bucket posture holding mode from an operator. The bucket posture holding mode is a mode in which the control device 200 controls the bucket cylinder 308, the tilt cylinder 309, and the rotary motor 310 to automatically hold the posture of the bucket 164 in the global coordinate system. The monitor device 272 is implemented by, for example, a computer including a touch panel.

The control device 200 controls the undercarriage 120, the swing body 140, and the work equipment 160, based on the operation of the operation device 271 by the operator. The control device 200 is provided, for example, inside the cab 180.

«Drive System of Work Machine 100»

Figure 3:
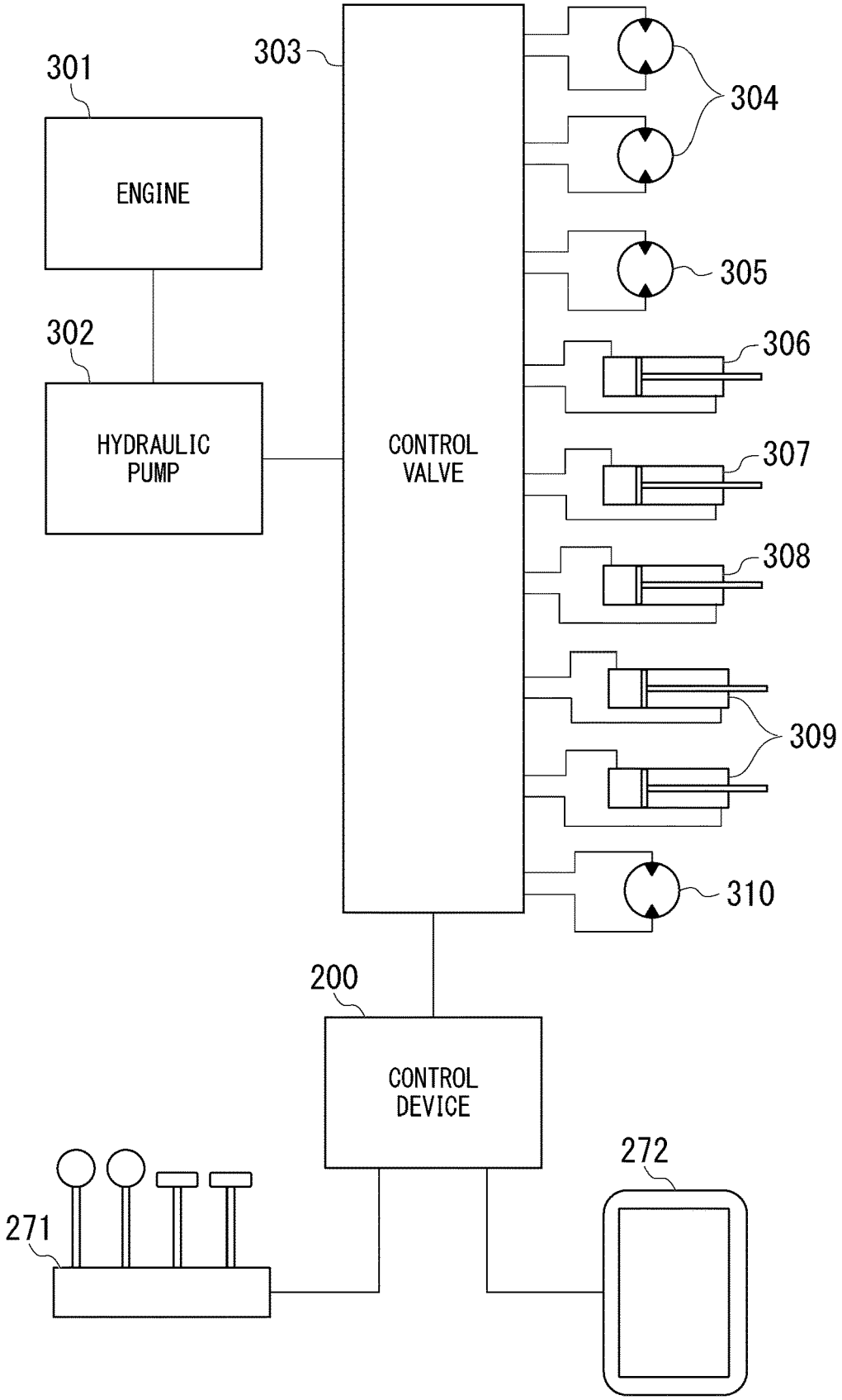
FIG. 3 is a diagram showing the configuration of a drive system of the work machine 100 according to the first embodiment.

FIG. 3 is a diagram showing the configuration of a drive system of the work machine 100 according to the first embodiment.

The work machine 100 includes a plurality of actuators for driving the work machine 100. Specifically, the work machine 100 includes an engine 301, a hydraulic pump 302, a control valve 303, a pair of traveling motors 304, the swing motor 305, the boom cylinder 306, the arm cylinder 307, the bucket cylinder 308, the tilt cylinder 309, and the rotary motor 310.

The engine 301 is a prime mover that drives the hydraulic pump 302.

The hydraulic pump 302 is driven by the engine 301 and supplies hydraulic oil to the traveling motor 304, the swing motor 305, the boom cylinder 306, the arm cylinder 307, and the bucket cylinder 308 via the control valve 303.

The control valve 303 controls the flow rate of the hydraulic oil to be supplied from the hydraulic pump 302 to the traveling motor 304, the swing motor 305, the boom cylinder 306, the arm cylinder 307, and the bucket cylinder 308.

The traveling motor 304 is driven by the hydraulic oil supplied from the hydraulic pump 302 to drive the undercarriage 120.

The swing motor 305 is driven by the hydraulic oil supplied from the hydraulic pump 302 and causes the swing body 140 to swing with respect to the undercarriage 120.

The boom cylinder 306 is a hydraulic cylinder that drives the boom 161. The base end portion of the boom cylinder 306 is attached to the swing body 140. The distal end portion of the boom cylinder 306 is attached to the boom 161.

The arm cylinder 307 is a hydraulic cylinder for driving the arm 162. The base end portion of the arm cylinder 307 is attached to the boom 161. The distal end portion of the arm cylinder 307 is attached to the arm 162.

The bucket cylinder 308 is a hydraulic cylinder for driving the tilt rotator 163 and the bucket 164. The base end portion of the bucket cylinder 308 is attached to the arm 162. The distal end portion of the bucket cylinder 308 is attached to the tilt rotator 163 via a link member.

The tilt cylinder 309 is a hydraulic cylinder for driving the tilt portion 1632. The base end portion of the tilt cylinder 309 is attached to the attachment portion 1631. The distal end portion of the rod of the tilt cylinder 309 is attached to the tilt portion 1632.

The rotary motor 310 is a hydraulic motor for driving the rotation portion 1633. The bracket and stator of the rotary motor 310 are fixed to the tilt portion 1632. The rotation axis and rotor of the rotary motor 310 are provided to extend in the up-down direction in the drawing and are fixed to the rotation portion 1633.

«Measurement System of Work Machine 100»

The work machine 100 includes a plurality of sensors for measuring the posture, azimuth direction, and position of the work machine 100. Specifically, the work machine 100 includes an inclination measurer 401, a position/azimuth direction measurer 402, a boom angle sensor 403, an arm angle sensor 404, a bucket angle sensor 405, a tilt angle sensor 406, and a rotation angle sensor 407.

The inclination measurer 401 measures the posture of the swing body 140. The inclination measurer 401 measures inclination (for example, roll angle, pitch angle, and yaw angle) of the swing body 140 with respect to a horizontal plane. Examples of the inclination measurer 401 include an inertial measurement unit (IMU). In this case, the inclination measurer 401 measures the acceleration and angular velocity of the swing body 140 and calculates the inclination of the swing body 140 with respect to the horizontal plane on the basis of the measurement result. The inclination measurer 401 is provided, for example, below the cab 180. The inclination measurer 401 outputs the posture data of the swing body 140, which is a measured value, to the control device 200.

The position/azimuth direction measurer 402 measures a position of a representative point of the swing body 140 and an azimuth direction in which the swing body 140 faces by a global navigation satellite system (GNSS). The position/azimuth direction measurer 402 includes, for example, two GNSS antennas (not shown) attached to the swing body 140, and measures an azimuth direction orthogonal to a straight line connecting positions of the two antennas as an azimuth direction in which the work machine 100 faces. The position/azimuth direction measurer 402 outputs position data and azimuth direction data of the swing body 140, which are measured values, to the control device 200.

The boom angle sensor 403 measures a boom angle, which is the angle of the boom 161 with respect to the swing body 140. The boom angle sensor 403 may be an IMU attached to the boom 161. In this case, the boom angle sensor 403 measures the boom angle, based on the inclination of the boom 161 with respect to the horizontal plane and the inclination of the swing body measured by the inclination measurer 401. The measured value of the boom angle sensor 403 indicates zero, for example, when the direction of a straight line passing through the base end and the distal end of the boom 161 coincides with the front-rear direction of the swing body 140. The boom angle sensor 403 according to another embodiment may be a stroke sensor attached to the boom cylinder 306. In addition, the boom angle sensor 403 according to another embodiment may be a rotation sensor provided at a joint shaft that rotatably connects the swing body 140 and the boom 161. The boom angle sensor 403 outputs boom angle data, which is the measured value, to the control device 200.

The arm angle sensor 404 measures an arm angle, which is the angle of the arm 162 with respect to the boom 161. The arm angle sensor 404 may be an IMU attached to the arm 162. In this case, the arm angle sensor 404 measures the arm angle, based on the inclination of the arm 162 with respect to the horizontal plane and the boom angle measured by the boom angle sensor 403. The measured value of the arm angle sensor 404 indicates zero, for example, when the direction of the straight line passing through the base end and the distal end of the arm 162 coincides with the direction of the straight line passing through the base end and the distal end of the boom 161. The arm angle sensor 404 according to another embodiment may calculate an angle by attaching a stroke sensor to the arm cylinder 307. In addition, the arm angle sensor 404 according to another embodiment may be a rotation sensor provided at a joint shaft that rotatably connects the boom 161 and the arm 162. The arm angle sensor 404 outputs arm angle data, which is the measured value, to the control device 200.

The bucket angle sensor 405 measures a bucket angle, which is the angle of the tilt rotator 163 with respect to the arm 162. The bucket angle sensor 405 may be a stroke sensor provided in the bucket cylinder 308. In this case, the bucket angle sensor 405 measures the bucket angle, based on the stroke amount of the bucket cylinder 308. The measured value of the bucket angle sensor 405 indicates zero, for example, when the direction of the straight line passing through the base end and the teeth of the bucket 164 coincides with the direction of the straight line passing through the base end and the distal end of the arm 162. Incidentally, the bucket angle sensor 405 according to another embodiment may be a rotation sensor provided on a joint shaft that rotatably connects the arm 162 and the attachment portion 1631 of the tilt rotator 163. In addition, the bucket angle sensor 405 according to another embodiment may be an IMU attached to the bucket 164. The bucket angle sensor 405 outputs bucket angle data, which is the measured value, to the control device 200.

The tilt angle sensor 406 measures a tilt angle, which is the angle of the tilt portion 1632 with respect to the attachment portion 1631 of the tilt rotator 163. The tilt angle sensor 406 may be a rotation sensor provided in a joint shaft that rotatably connects the attachment portion 1631 and the tilt portion 1632. The measured value of the tilt angle sensor 406 indicates zero, for example, when the rotation axis of the arm 162 and the rotation axis of the rotation portion 1633 are orthogonal to each other. The tilt angle sensor 406 according to another embodiment may calculate the angle by attaching the stroke sensor to the tilt cylinder 309. The tilt angle sensor 406 outputs tilt angle data, which is the measured value, to the control device 200.

The rotation angle sensor 407 measures a rotation angle, which is the angle of the rotation portion 1633 with respect to the tilt portion 1632 of the tilt rotator 163. The rotation angle sensor 407 may be a rotation sensor provided in the rotary motor 310. The measured value of the tilt angle sensor 406 indicates zero, for example, when the tooth direction of the bucket 164 and the operation plane of the work equipment 160 are orthogonal to each other. The rotation angle sensor 407 outputs rotation angle data, which is the measured value, to the control device 200.

«Configuration of Control Device 200»

Figure 4:
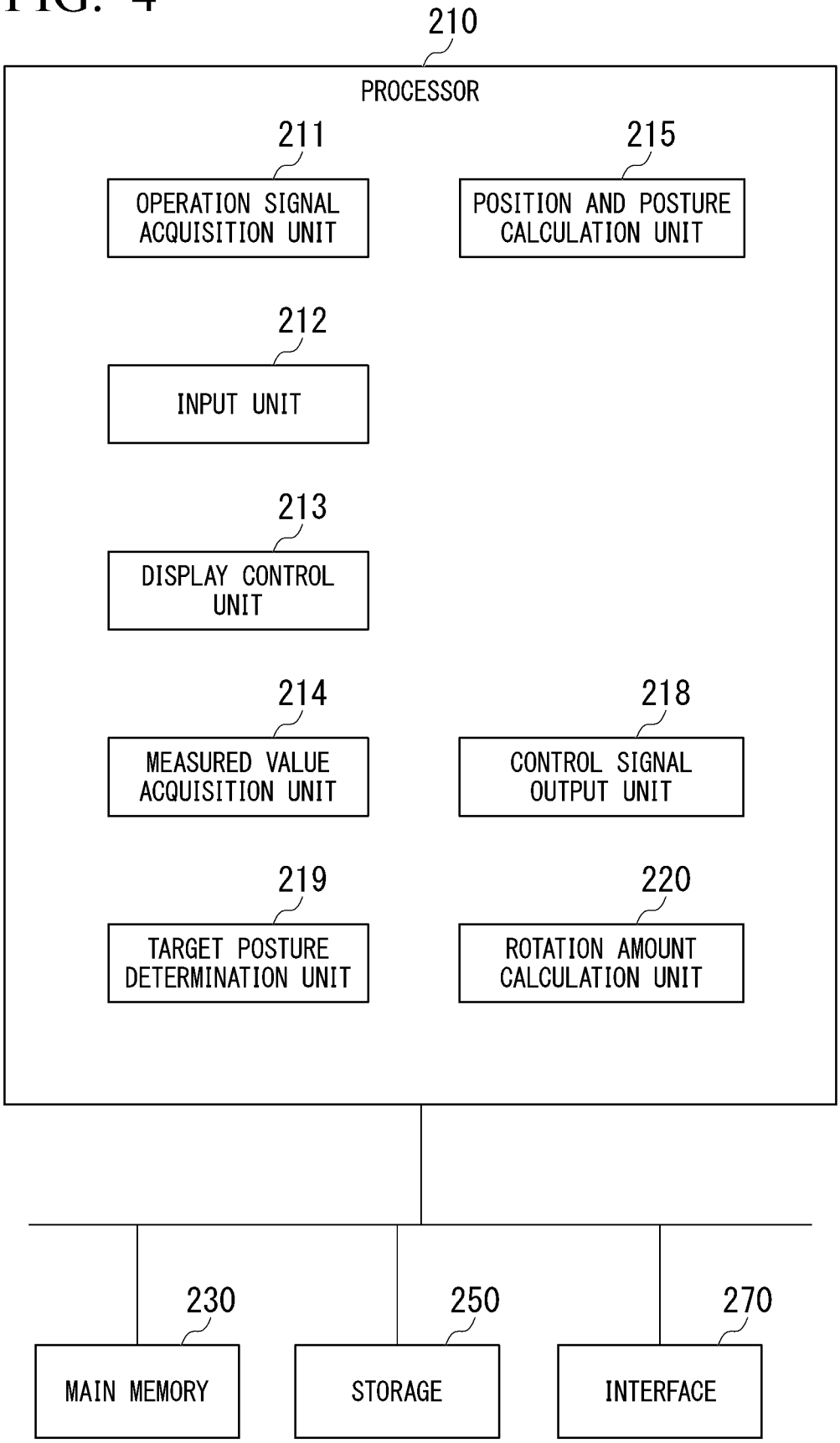
FIG. 4 is a schematic block diagram showing the configuration of a control device 200 according to the first embodiment.

FIG. 4 is a schematic block diagram showing the configuration of the control device 200 according to the first embodiment.

The control device 200 is a computer that includes a processor 210, a main memory 230, a storage 250, and an interface 270. The control device 200 is an example of a control system. The control device 200 receives measured values from the inclination measurer 401, the position/azimuth direction measurer 402, the boom angle sensor 403, the arm angle sensor 404, the bucket angle sensor 405, the tilt angle sensor 406, and the rotation angle sensor 407.

The storage 250 is a non-transitory, tangible storage medium. As the storage 250, magnetic disks, optical disks, magneto-optical disks, semiconductor memories, and the like are exemplary examples. The storage 250 may be internal media directly connected to a bus of the control device 200, or may be external media connected to the control device 200 via the interface 270 or a communication line. The operation device 271 and the monitor device 272 are connected to the processor 210 via the interface 270.

The storage 250 stores control programs for controlling the work machine 100. The control programs may be for implementing part of the functions that the control device 200 is caused to exhibit. For example, the control program may function in combination with another program already stored in the storage 250 or in combination with another program implemented in another device. In addition, in other embodiments, the control device 200 may include a customized large scale integrated circuit (LSI) such as a programmable logic device (PLD) in addition to or instead of the above configuration. Examples of PLD include Programmable Array Logic (PAL), Generic Array Logic (GAL), Complex Programmable Logic Device (CPLD), and Field Programmable Gate Array (FPGA). In this case, part or all of the functions realized by the processor may be realized by the integrated circuit.

In the storage 250, geometric data representing dimensions and positions of the centers of gravity of the swing body 140, the boom 161, the arm 162, and the bucket 164 is recorded. The geometric data is data representing the position of an object in a predetermined coordinate system. In addition, design surface data, which is three-dimensional data representing the shape of the design surface at the construction site in the global coordinate system, is recorded in the storage 250. The global coordinate system is a coordinate system composed of an $X_g$ axis extending in the latitude direction, a $Y_g$ axis extending in the longitudinal direction, and a $Z_g$ axis extending in the vertical direction. The design surface data is represented by, for example, Triangular Irregular Networks (TIN) data.

«Software Configuration»

By executing the control program, the processor 210 includes an operation signal acquisition unit 211, an input unit 212, a display control unit 213, a measured value acquisition unit 214, a position and posture calculation unit 215, a control signal output unit 218, a target posture determination unit 219, and a rotation amount calculation unit 220.

The operation signal acquisition unit 211 acquires an operation signal indicating an operation amount of each actuator from the operation device 271.

The input unit 212 receives an operation input by the operator from the monitor device 272.

The display control unit 213 outputs screen data to be displayed on the monitor device 272 to the monitor device 272.

The measured value acquisition unit 214 acquires measured values from the inclination measurer 401, the position/azimuth direction measurer 402, the boom angle sensor 403, the arm angle sensor 404, the bucket angle sensor 405, the tilt angle sensor 406, and the rotation angle sensor 407.

The position and posture calculation unit 215 calculates the position of the work machine 100 in the global coordinate system and the vehicle body coordinate system, based on various measured values acquired by the measured value acquisition unit 214 and the geometric data recorded in the storage 250. For example, the position and posture calculation unit 215 calculates positions of the teeth of the bucket 164 in the global coordinate system and the vehicle body coordinate system. The vehicle body coordinate system is a Cartesian coordinate system of which origin is a representative point of the swing body 140 (for example, a point passing through the swing center). The calculation by the position and posture calculation unit 215 will be described later.

The control signal output unit 218 outputs the operation amount acquired by the operation signal acquisition unit 211 or the control signal of each actuator (the bucket cylinder 308, the tilt cylinder 309, and the rotary motor 310) according to the target values calculated by the rotation amount calculation unit 220, to the control valve 303.

The functions of the target posture determination unit 219 and the rotation amount calculation unit 220 will be described in detail when describing a dump operation assist control described below.

«Calculation by Position and Posture Calculation Unit 215»

Here, a method for calculating the position of the point on the outer shell of the work machine 100 by the position and posture calculation unit 215 will be described. The position and posture calculation unit 215 calculates the position of the point on the outer shell, based on various measured values acquired by the measured value acquisition unit 214 and the geometric data recorded in the storage 250. In the storage 250, geometric data representing dimensions of the swing body 140, the boom 161, the arm 162, the tilt rotator 163 (attachment portion 1631, tilt portion 1632, and rotation portion 1633), and the bucket 164 is recorded.

The geometric data of the swing body 140 indicates the center position ($x_{bm}$, $y_{bm}$, $z_{bm}$) of the joint shaft where the swing body 140 supports the boom 161, in the vehicle body coordinate system that is the local coordinate system. The vehicle body coordinate system is a coordinate system composed of an $X_{sb}$ axis extending in the front-rear direction, a $Y_{sb}$ axis extending in the left-right direction, and a $Z_{sb}$ axis extending in the up-down direction with the swing center of the swing body 140 as a reference. The up-down direction of the swing body 140 does not necessarily coincide with the vertical direction.

The geometric data of the boom 161 indicates the position ($x_{am}$, $y_{am}$, $z_{am}$) of the joint shaft where the boom 161 supports the arm 162, in the boom coordinate system that is the local coordinate system. The boom coordinate system is a coordinate system composed of an $X_{bm}$ axis extending in a longitudinal direction, a $Y_{bm}$ axis extending in a direction where the joint shaft extends, and a $Z_{bm}$ axis orthogonal to the $X_{bm}$ axis and the $Y_{bm}$ axis, with a center position of the joint shaft connecting the swing body 140 and the boom 161 as a reference.

The geometric data of the arm 162 indicates the position ($x_{t1}$, $y_{t1}$, $z_{t1}$) of the joint shaft where the arm 162 supports the attachment portion 1631 of the tilt rotator 163, in the arm coordinate system that is the local coordinate system. The arm coordinate system is a coordinate system composed of an $X_{am}$ axis extending in a longitudinal direction, a $Y_{am}$ axis extending in a direction where the joint shaft extends, and a $Z_{am}$ axis orthogonal to the $X_{am}$ axis and the $Y_{am}$ axis, with a center position of the joint shaft connecting the boom 161 and the arm 162 as a reference.

The geometric data of the attachment portion 1631 of the tilt rotator 163 indicates the position ($x_{t2}$, $y_{t2}$, $z_{t2}$) of the joint shaft where the attachment portion 1631 supports the tilt portion 1632 and the inclination ($\varphi_t$) of the joint shaft, in the first tilt-rotate coordinate system that is the local coordinate system. The inclination $\varphi_t$ of the joint shaft is an angle related to a design error of the tilt rotator 163, and is obtained by calibration of the tilt rotator 163 or the like. The first tilt-rotate coordinate system is a coordinate system composed of a $Y_{t1}$ axis extending in a direction where the joint shaft connecting the arm 162 and the attachment portion 1631 extends, a $Z_{t1}$ axis extending in a direction where the joint shaft connecting the attachment portion 1631 and the tilt portion 1632 extends, and a $X_{t1}$ axis orthogonal to the $Y_{t1}$ axis and the $Z_{t1}$ axis, with the center position of the joint shaft connecting the arm 162 and the attachment portion 1631 as a reference.

The geometric data of the tilt portion 1632 of the tilt rotator 163 indicates the distal end position ($x_{t3}$, $y_{t3}$, $z_{t3}$) of the rotation axis of the rotary motor 310 and an inclination (er) of the rotation axis, in the second tilt-rotate coordinate system that is the local coordinate system. The inclination er of the rotation axis is an angle related to a design error of the tilt rotator 163, and is obtained by calibration of the tilt rotator 163 or the like. The second tilt-rotate coordinate system is a coordinate system composed of a $X_{t2}$ axis extending in a direction where the joint shaft connecting the attachment portion 1631 and the tilt portion 1632 extends, a $Z_{t2}$ axis extending in a direction where the rotation axis of the rotary motor 310 extends, and a $Y_{t2}$ axis orthogonal to the $X_{t2}$ axis and the $Z_{t2}$ axis, with the center position of the joint shaft connecting the attachment portion 1631 and the tilt portion 1632 as a reference.

The geometric data of the rotation portion 1633 of the tilt rotator 163 indicates the center position ($x_{t4}$, $y_{t4}$, $z_{t4}$) of the attachment surface of the bucket 164 in the third tilt-rotate coordinate system that is the local coordinate system. The third tilt-rotate coordinate system is a coordinate system composed of a $Z_{t3}$ axis extending in a direction where the rotation axis of the rotary motor 310 extends, and a $X_{t3}$ axis and a $Y_{t3}$ axis orthogonal to the rotation axis, with the center position of the attachment surface of the bucket 164 as a reference. The bucket 164 is attached to the rotation portion 1633 such that the teeth are parallel to the $Y_{t3}$ axis.

The geometric data of the bucket 164 indicates the positions ($x_{bk}$, $y_{bk}$, $z_{bk}$) of the plurality of contour points of the bucket 164 in the third tilt-rotate coordinate system. Examples of the contour points include positions of both ends and the center of the teeth of the bucket 164, positions of both ends and the center of the bottom portion of the bucket 164, and positions of both ends and the center of the heel of the bucket 164.

The position and posture calculation unit 215 generates a boom-vehicle body conversion matrix $T^{bm}{}_{sb}$ for conversion from the boom coordinate system to the vehicle body coordinate system by using the following Equation (1), based on the measured value of the boom angle $\theta_{bm}$ acquired by the measured value acquisition unit 214 and the geometric data of the swing body 140. The boom-vehicle body conversion matrix $T^{bm}{}_{sb}$ is a matrix for rotating around the $Y_{bm}$ axis by the boom angle $\theta_{bm}$ and translating by the deviation ($x_{bm}$, $y_{bm}$, $z_{bm}$) between the origin of the vehicle body coordinate system and the origin of the boom coordinate system.

[Equation 1]

$$T_{sb}^{bm} = \begin{bmatrix} \cos\theta_{bm} & 0 & \sin\theta_{bm} & x_{bm} \\ 0 & 1 & 0 & y_{bm} \\ -\sin\theta_{bm} & 0 & \cos\theta_{bm} & z_{bm} \\ 0 & 0 & 0 & 1 \end{bmatrix} \quad (1)$$

The position and posture calculation unit 215 generates an arm-boom conversion matrix $T^{am}{}_{bm}$ for conversion from the arm coordinate system to the boom coordinate system by using the following Equation (2), based on the measured value of the arm angle $\theta_{am}$ acquired by the measured value acquisition unit 214 and the geometric data of the boom 161. The arm-boom conversion matrix $T^{am}{}_{bm}$ is a matrix for rotating around the $Y_{am}$ axis by the arm angle $\theta_{am}$ and translating by the deviation ($x_{am}$, $y_{am}$, $z_{am}$) between the origin of the boom coordinate system and the origin of the arm coordinate system. In addition, the position and posture calculation unit 215 calculates a product of the boom-vehicle body conversion matrix $T^{bm}{}_{sb}$ and the arm-boom conversion matrix $T^{am}{}_{bm}$ to generate the arm-vehicle body conversion matrix $T^{am}{}_{sb}$ for converting from the arm coordinate system to the vehicle body coordinate system.

[Equation 2]

$$T_{bm}^{am} = \begin{bmatrix} \cos\theta_{am} & 0 & \sin\theta_{am} & x_{am} \\ 0 & 1 & 0 & y_{am} \\ -\sin\theta_{am} & 0 & \cos\theta_{am} & z_{am} \\ 0 & 0 & 0 & 1 \end{bmatrix} \quad (2)$$

The position and posture calculation unit 215 generates a first tilt-arm conversion matrix $T^{t1}{}_{am}$ for conversion from the first tilt-rotate coordinate system to the arm coordinate system by using the following Equation (3), based on the measured value of the bucket angle $\theta_{bk}$ acquired by the measured value acquisition unit 214 and the geometric data of the arm 162. The first tilt-arm conversion matrix $T^{t1}{}_{am}$ is a matrix that rotates around the $Y_{t1}$ axis by the bucket angle $\theta_{bk}$, translates by the deviation ($x_{t1}$, $y_{t1}$, $z_{t1}$) between the origin of the arm coordinate system and the origin of the first tilt-rotate coordinate system, and further tilts by the inclination $\varphi_t$ of the joint shaft of the tilt portion 1632. In addition, the position and posture calculation unit 215 calculates a product of the arm-vehicle body conversion matrix $T^{am}{}_{sb}$ and the first tilt-arm conversion matrix $T^{t1}{}_{am}$ to generate the first tilt-vehicle body conversion matrix $T^{t1}{}_{sb}$ for converting from the first tilt-rotate coordinate system to the vehicle body coordinate system.

[Equation 3]

$$T_{am}^{t1} = \begin{bmatrix} \cos(\theta_{bk} - \phi_t) & 0 & \sin(\theta_{bk} - \phi_t) & x_{t1} \\ 0 & 1 & 0 & y_{t1} \\ -\sin(\theta_{bk} - \phi_t) & 0 & \cos(\theta_{bk} - \phi_t) & z_{t1} \\ 0 & 0 & 0 & 1 \end{bmatrix} \quad (3)$$

The position and posture calculation unit 215 generates a second tilt-first tilt conversion matrix $T^{t}{}_{t1}$ for conversion from the first tilt-rotate coordinate system to the second tilt-rotate coordinate system by using the following Equation (4), based on the measured value of the tilt angle $\theta_t$ acquired by the measured value acquisition unit 214 and the geometric data of the tilt rotator 163. The second tilt-first tilt conversion matrix $T^{t2}{}_{t1}$ is a matrix that rotates around the $X_{t2}$ axis by the tilt angle $\theta_t$, translates by the deviation ($x_{t2}$, $y_{t2}$, $z_{t2}$) between the origin of the first tilt-rotate coordinate system and the origin of the second tilt-rotate coordinate system, and further tilts by the inclination $\varphi_r$ of the rotation axis of the rotation portion 1633. In addition, the position and posture calculation unit 215 calculates a product of the first tilt-vehicle body conversion matrix $T^{t1}{}_{sb}$ and the second tilt-first tilt conversion matrix $T^{t2}{}_{t1}$ to generate the second tilt-vehicle body conversion matrix $T^{t2}{}_{sb}$ for converting from the second tilt-rotate coordinate system to the vehicle body coordinate system.

[Equation 4]

$$T_{t1}^{t2} = \begin{bmatrix} 1 & 0 & 0 & x_{t2} \\ 0 & \cos\theta_t & -\sin\theta_t & y_{t2} \\ 0 & \sin\theta_t & \cos\theta_t & z_{t2} \\ 0 & 0 & 0 & 1 \end{bmatrix} \begin{bmatrix} \cos\phi_r & 0 & \sin\phi_r & 0 \\ 0 & 1 & 0 & 0 \\ -\sin\phi_r & 0 & \cos\phi_r & 0 \\ 0 & 0 & 0 & 1 \end{bmatrix} \quad (4)$$

The position and posture calculation unit 215 generates a third tilt-second tilt conversion matrix $T^{t3}{}_{t2}$ for conversion from the second tilt-rotate coordinate system to the third tilt-rotate coordinate system by using the following Equation (5), based on the measured value of the rotation angle $\theta_r$ acquired by the measured value acquisition unit 214 and the geometric data of the tilt rotator 163. The third tilt-second tilt conversion matrix $T^{t3}{}_{t2}$ is a matrix that rotates around the $Z_{t3}$ axis by the rotation angle $\theta_r$, and translates by the deviation ($x_{t3}$, $y_{t3}$, $z_{t3}$) between the origin of the second tilt-rotate coordinate system and the origin of the third tilt-rotate coordinate system. In addition, the position and posture calculation unit 215 calculates a product of the second tilt-vehicle body conversion matrix $T^{t2}{}_{sb}$ and the third tilt-second tilt conversion matrix $T^{t3}_{t2}$ to generate the third tilt-vehicle body conversion matrix $T^{t3}_{sb}$ for converting from the third tilt-rotate coordinate system to the vehicle body coordinate system.

[Equation 5]

$$T^{t3}_{t2} = \begin{bmatrix} \cos\theta_r & -\sin\theta_r & 0 & x_{t3} \\ \sin\theta_r & \cos\theta_r & 0 & y_{t3} \\ 0 & 0 & 1 & z_{t3} \\ 0 & 0 & 0 & 1 \end{bmatrix} \quad (5)$$

The position and posture calculation unit 215 can calculate the positions of the plurality of contour points of the bucket 164 in the vehicle body coordinate system, by calculating the sum of the center positions ($x_{t4}$, $y_{t4}$, $z_{t4}$) of the attachment surface of the bucket 164 and the positions ($x_{bk}$, $y_{bk}$, $z_{bk}$) of the plurality of contour points in the third tilt-rotate coordinate system indicated by the geometric data of the bucket 164 and the product of the center positions ($x_{t4}$, $y_{t4}$, $z_{t4}$) and the third tilt-vehicle body conversion matrix $T^{bk}_{sb}$.

Incidentally, the angle of the teeth of the bucket 164 with respect to the ground plane of the work machine 100, that is, the angle formed by the $X_{sb}$-$Y_{sb}$ plane of the vehicle body coordinate system and the $Y_{t3}$ axis of the third tilt-rotate coordinate system is determined by the boom angle $\theta_{bm}$, the arm angle $\theta_{am}$, the bucket angle $\theta_{bk}$, the tilt angle $\theta_t$, and the rotation angle $\theta_r$. Accordingly, as shown in FIG. 1, the position and posture calculation unit 215 specifies the bucket coordinate system starting from the base end portion of the bucket 164, that is, the center position of the attachment surface of the bucket 164 in the tilt rotator 163. The bucket coordinate system is a Cartesian coordinate system including an $X_{bk}$ axis extending in a direction where the teeth of the bucket 164 face, a $Y_{bk}$ axis orthogonal to the $X_{bk}$ axis and extending along the teeth of the bucket 164, and a $Z_{bk}$ axis orthogonal to the $X_{bk}$ axis and the $Y_b$k axis. Hereinafter, the $X_{bk}$ axis will also be referred to as a bucket tilt axis, the $Y_{bk}$ axis will also be referred to as a bucket pitch axis, and the $Z_{bk}$ axis will also be referred to as a bucket rotation axis. The bucket tilt axis $X_{bk}$, the bucket pitch axis $Y_{bk}$, and the bucket rotation axis $Z_{bk}$ are virtual axes and are different from the joint shaft of the tilt rotator 163. Incidentally, when the inclination of the rotation axis of the rotary motor 310 is zero, the bucket coordinate system and the third tilt-rotate coordinate system coincide with each other.

The position and posture calculation unit 215 generates a bucket-third tilt conversion matrix $T^{bk}_{t3}$ for converting the third tilt-rotate coordinate system into the bucket coordinate system according to the following Equation (6) based on the geometric data of the tilt rotator 163. The bucket-third tilt conversion matrix $T^{bk}_{t3}$ is a matrix that rotates around the $Y_{t3}$ axis by the inclination (pr of the rotation axis.

[Equation 6]

$$T^{bk}_{t3} = \begin{bmatrix} \cos(-\phi_r) & 0 & \sin(-\phi_r) & 0 \\ 0 & 1 & 0 & 0 \\ -\sin(-\phi_r) & 0 & \cos(-\phi_r) & 0 \\ 0 & 0 & 0 & 1 \end{bmatrix} \quad (6)$$

«Dump Operation Assist Control»

Hereinafter, a dump operation assist control according to the present embodiment will be described in detail with reference to the drawings. The dump operation is used when performing excavation work or dump work, and is control for rotating the bucket 164 along the opening direction of the bucket 164. In the present embodiment, since the bucket 164 is rotatably supported around three axes intersecting with each other on different planes with respect to the work equipment 160 via the tilt rotator 163, the operator is required to perform a compound operation. Therefore, the dump operation assist control controls the tilt rotator 163 such that the bucket 164 rotates around a virtual rotation axis determined corresponding to the reference direction, with the opening direction of the bucket 164 as a reference direction. In the present embodiment, the bucket pitch axis $Y_{bk}$ orthogonal to the bucket tilt axis $X_{bk}$ and extending along the teeth of the bucket 164 is determined as a virtual rotation axis, and at least any one of the bucket cylinder 308, the tilt cylinder 309, and the rotary motor 310 is controlled such that the bucket 164 rotates around the virtual rotation axis. The dump operation assist control calculates rotation amounts around the three axes so as to rotate the bucket 164 around the bucket pitch axis $Y_{bk}$ by an amount corresponding to an operation amount indicated by an operation signal from the operation device, and controls the tilt rotator 163.

First, the operation signal acquisition unit 211, the control signal output unit 218, the target posture determination unit 219, and the rotation amount calculation unit 220 in FIG. 4 will be described in detail.

In addition to the above-described functions, the operation signal acquisition unit 211 acquires an operation amount to an operation reception portion (hereinafter, also referred to as a dump assist operation reception portion) dedicated for using the dump operation assist control in the operation device 271.

The target posture determination unit 219 determines a target posture, which is a posture obtained by rotating the bucket 164 around the virtual rotation axis from the current posture, by an amount corresponding to the operation amount acquired by the operation signal acquisition unit 211. The virtual rotation axis is a rotation axis determined corresponding to an opening direction of the bucket 164, and more specifically, the virtual rotation axis is determined to draw an orbit where the bucket 164 rotates along the opening direction. In the present embodiment, the bucket pitch axis ($Y_{bk}$ axis, refer to FIG. 1) in the above-described bucket coordinate system is determined as the virtual rotation axis.

The rotation amount calculation unit 220 calculates a rotation amount for each of the plurality of rotation mechanisms required to align the current posture of the bucket 164 with the target posture. Here, the plurality of rotation mechanisms in the present embodiment are the bucket cylinder 308, the tilt cylinder 309, and the rotary motor 310. As shown in FIGS. 1 and 2, the bucket cylinder 308 rotates the bucket 164 around the $Y_{t1}$ axis. The tilt cylinder 309 rotates the bucket 164 around the $X_2$ axis. In addition, the rotary motor 310 rotates the bucket 164 around the $Z_{t3}$ axis.

Next, a flow of processing of the dump operation assist control by the control device 200 of the present embodiment will be described with reference to FIGS. 5 to 8.

Figure 5:
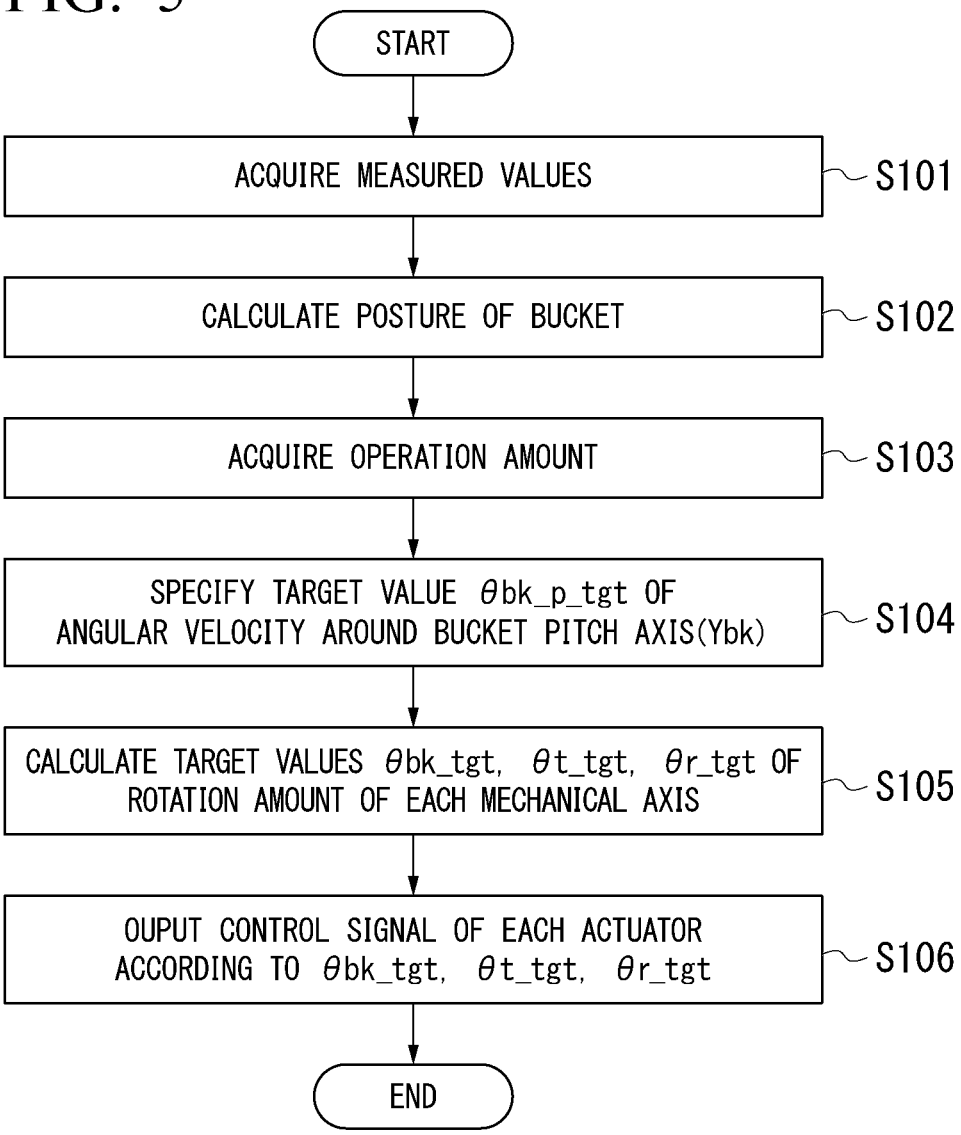
FIG. 5 is a flowchart showing dump operation assist control in the first embodiment.

FIG. 5 is a flowchart showing dump operation assist control in the first embodiment. When the operator of the work machine 100 starts to operate the work machine 100, the control device 200 executes the following controls at predetermined control cycles (for example, 1000 milliseconds).

First, the measured value acquisition unit 214 acquires measured values from the inclination measurer 401, the position/azimuth direction measurer 402, the boom angle sensor 403, the arm angle sensor 404, the bucket angle sensor 405, the tilt angle sensor 406, and the rotation angle sensor 407 (step S101).

The position and posture calculation unit 215 calculates the posture of the bucket in the vehicle body coordinate system based on the measured value acquired in step S101 (step S102). The posture of the bucket in the vehicle body coordinate system is represented by a posture matrix $R_{cur}$ indicating a direction of each axis ($X_{bk}$, $Y_{bk}$, $Z_{bk}$) of the bucket coordinate system in the vehicle body coordinate system. All translation components of the posture matrix $R_{cur}$ representing the posture of the bucket 164 are set to zero.

The operation signal acquisition unit 211 acquires an operation amount to the dump assist operation reception portion by the operator (step S103).

Figure 6:
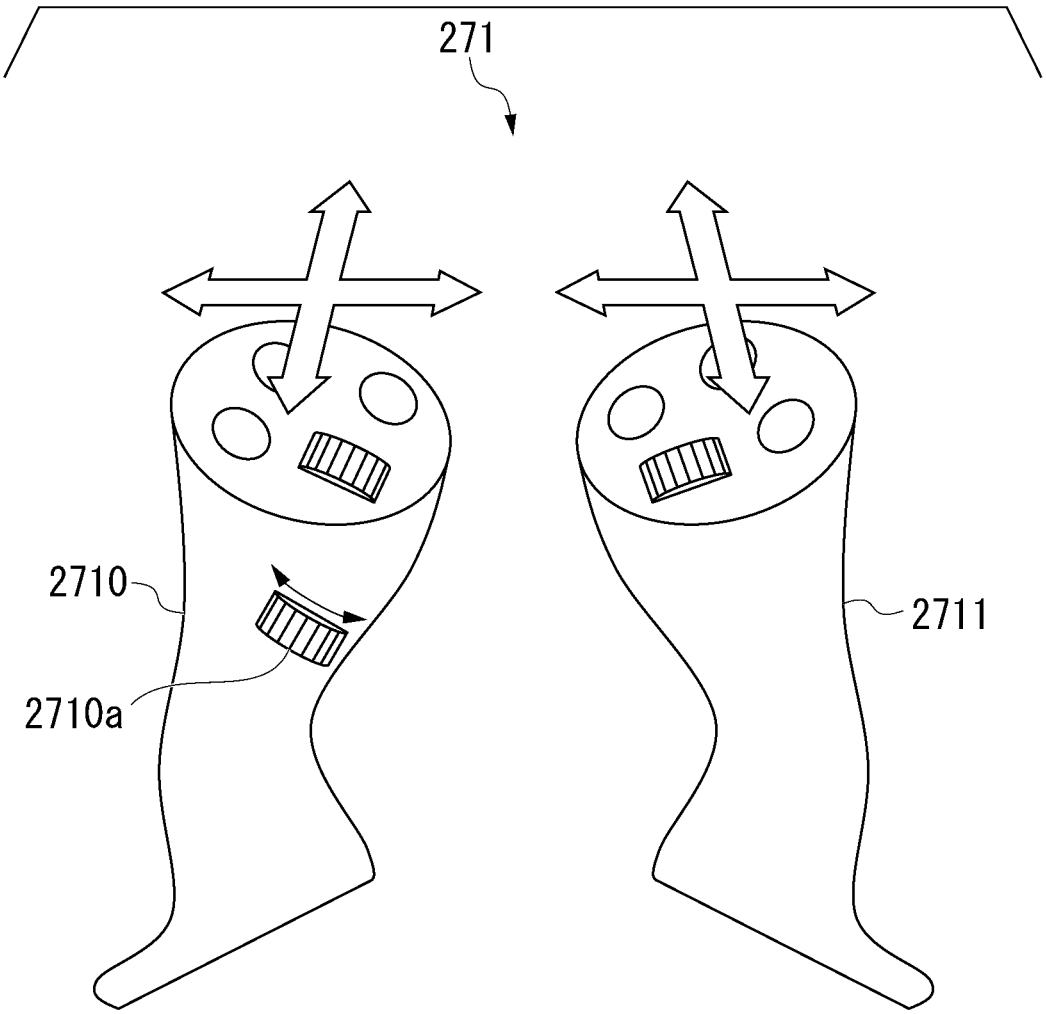
FIG. 6 is a diagram showing details of an operation device in the first embodiment.

In the present embodiment, the operation device 271 is provided with, for example, two levers 2710 and 2711 as shown in FIG. 6. In the work machine 100 according to the present embodiment, as in a normal work machine, an operator can tilt the two levers 2710 and 2711 in the front-rear direction and the left-right direction, so that the operator can operate the swing operation of the swing body 140 or the boom angle $\theta_{bm}$, the arm angle $\theta_{am}$, and the bucket angle $\theta_{bk}$, individually. In addition, the operator can individually control the tilt angle $\theta_t$ and the rotation angle $\theta_r$ via the tilt rotator 163 by operating operation reception portions (button, slide switch, dial, proportional roller type switch, and the like) provided on upper surface portions of the levers 2710 and 2711.

Furthermore, the operation device 271 according to the present embodiment includes a dump assist operation reception portion 2710*a* in the lever 2710. The dump assist operation reception portion 2710*a* is, for example, a proportional roller type switch that is biased by a spring so as to return to a central position. The operator can adjust the rotation direction and the rotation speed (angular velocity) of the bucket 164 along the opening direction by using the operation direction and the operation amount of the dump assist operation reception portion 2710*a*.

Returning to FIG. 5, next, the target posture determination unit 219 determines the bucket pitch axis $Y_{bk}$ as a virtual rotation axis, and specifies a target value $\theta_{bk_p_tgt}$ of an angular velocity around the bucket pitch axis $Y_{bk}$, according to the operation amount acquired in step S103 (step S104). For example, the target posture determination unit 219 specifies the target value $\theta_{bk_p_tgt}$ of an angular velocity around the bucket pitch axis $Y_{bk}$ such that the target value $\theta_{bk_p_tgt}$ increases as the operation amount increases. Incidentally, specifying the target value $\theta_{bk_p_tgt}$ of the angular velocity around the bucket pitch axis $Y_{bk}$ is equivalent to determining the target posture that the bucket 164 should have after a unit time has elapsed from the present time point.

Next, the rotation amount calculation unit 220 calculates the target value of the rotation amount of each of the plurality of rotation mechanisms required to align the current posture of the bucket 164 with the target posture, based on the target value $\theta_{bk_p_tgt}$ specified by the target posture determination unit 219 (step S105).

Specifically, the rotation amount calculation unit 220 creates a rotation matrix $R^{bk_p}{}_{bk}$ representing rotation around the bucket pitch axis $Y_{bk}$ in the bucket coordinate system by substituting the target value $\theta_{bk_t_tgt}$ of the angular velocity into the following Equation (7).

[Equation 7]

$$R_{bk}^{bk_p} = \begin{bmatrix} \cos\theta_{bk_p_tgt} & 0 & \sin\theta_{bk_p_tgt} & 0 \\ 0 & 1 & 0 & 0 \\ -\sin\theta_{bk_p_tgt} & 0 & \cos\theta_{bk_p_tgt} & 0 \\ 0 & 0 & 0 & 1 \end{bmatrix} \tag{7}$$

The rotation amount calculation unit 220 calculates the target posture $R_{tgt}$ of the bucket 164 after a unit time by multiplying the matrix $R_{cur}$ representing the current posture of the bucket 164 by the rotation matrix $R^{bk_p}{}_{bk}$ in Equation (7). The rotation amount calculation unit 220 calculates the target values ($\theta_{bk_tgt}$, $\theta_{t_tgt}$, $\theta_{r_tgt}$) of a bucket angle $\theta_{bk}$, a tilt angle $\theta_t$, and a rotation angle $\theta_r$ by using the following Equations (8), (9), and (10), based on the current posture $R_{cur}$ of the bucket 164 and the target posture $R_{tgt}$ of the bucket 164 after the unit time.

[Equation 8]

$$R_{cur}^{T} R_{tgt} = \begin{bmatrix} r_{11} & r_{12} & r_{13} & 0 \\ r_{21} & r_{22} & r_{23} & 0 \\ r_{31} & r_{32} & r_{33} & 0 \\ 0 & 0 & 0 & 1 \end{bmatrix} \tag{8}$$

[Equation 9]

$$\theta = \cos^{-1}\left(\frac{r_{11} + r_{22} + r_{33} - 1}{2}\right) \tag{9}$$

[Equation 10]

$$\begin{bmatrix} \theta_{t_tgt} \\ \theta_{bk_tgt} \\ \theta_{r_tgt} \end{bmatrix} = \begin{cases} [0 \;\; 0 \;\; 0]^T & (|\theta| < \varepsilon) \\ KR_{cur}\dfrac{\theta}{2\sin\theta}\begin{bmatrix} r_{32} - r_{23} \\ r_{13} - r_{31} \\ r_{21} - r_{12} \end{bmatrix} & (|\theta| \geq \varepsilon) \end{cases} \tag{10}$$

As described above, by the matrix conversion, the target value ($\theta_{bk_p_tgt}$) of the angular velocity around one virtual rotation axis is converted into the target value ($\theta_{bk_tgt}$, $\theta_{t_tgt}$, $\theta_{r_tgt}$) of the angular velocity around the three machine axes.

Next, the control signal output unit 218 generates the control signal of each actuator (the bucket cylinder 308, the tilt cylinder 309, and the rotary motor 310) according to the target values ($\theta_{bk_tgt}$, $\theta_{t_tgt}$, $\theta_{r_tgt}$) of the bucket angle $\theta_{bk}$, the tilt angle $\theta_t$, and the rotation angle $\theta_r$, and outputs the control signal of each actuator to the control valve 303 (step S106).

«Actions and Effects»

Next, an action and effect of the dump operation assist control according to the first embodiment will be described with reference to FIGS. 7 and 8.

Figure 7:
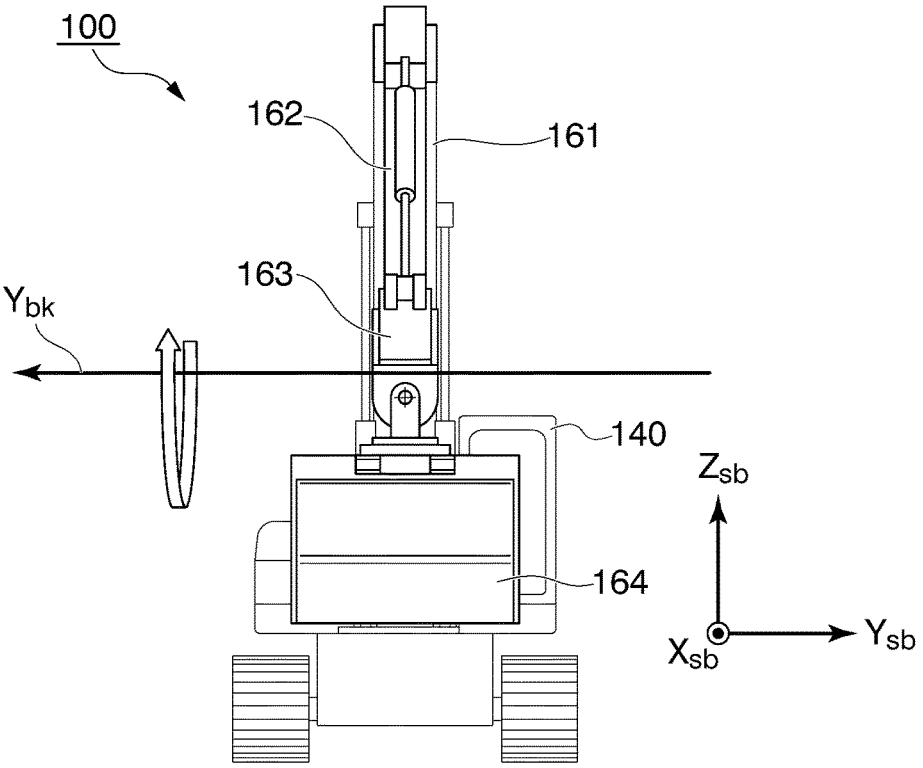
FIG. 7 is a view showing an action and effect of the dump operation assist control according to the first embodiment.
Figure 8:
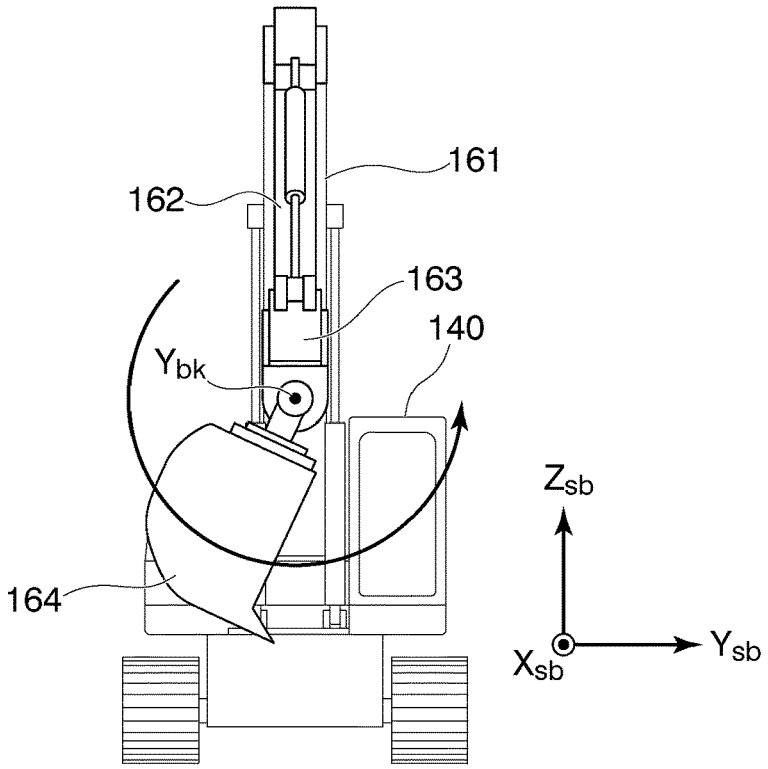
FIG. 8 is a view showing an action and effect of the dump operation assist control according to the first embodiment.

FIGS. 7 and 8 show a state in which the work machine 100 is viewed from the same angle.

Here, in FIG. 7, the opening direction of the bucket 164 faces the front surface of the paper surface, and the bucket pitch axis $Y_{bk}$ which is the virtual rotation axis has a posture parallel to the paper surface. In this case, when the operator operates the dump assist operation reception portion 2710*a* (see FIG. 6), the bucket 164 rotates around the bucket pitch axis $Y_{bk}$ parallel to the paper surface, and as a result, the bucket 164 rotates in the forward direction of the paper surface or the backward direction of the paper surface.

Similarly, in FIG. 8, the opening direction of the bucket 164 faces the right side of the paper surface, and the bucket pitch axis $Y_{bk}$ which is a virtual rotation axis has a posture perpendicular to the paper surface. The other angles are the same as in FIG. 7. In this case, when the operator operates the dump assist operation reception portion 2710*a* (see FIG. 6), the bucket 164 rotates around the bucket pitch axis $Y_{bk}$ perpendicular to the paper surface, and as a result, the bucket 164 rotates in the left direction of the paper surface or the right direction of the paper surface.

As described above, according to the control device 200 of the work machine 100 according to the present embodiment, the operator can rotate the bucket 164 along the opening direction of the bucket 164 only by performing an operation on the predetermined operation reception portion 2710*a*, regardless of which azimuth direction the opening direction of the bucket 164 faces with respect to the vehicle body (swing body 140). That is, while the operator is required to perform a complicated three-axis operation for machine axes ($\theta_{bk}$, $\theta_t$, $\theta_r$) in order to operate the bucket 164 in an opening direction of the bucket 164 in the related art, the operator can perform an one-axis operation on a predetermined operation reception portion 2710*a* in the work machine 100 according to the present embodiment. Thereby, it is possible to easily perform dump and excavation operations.

As described above, according to the control device 200 of the first embodiment, it is possible to simplify the operation for rotating the bucket 164 along the reference direction (opening direction) of the bucket 164, in the work machine 100 including the work equipment 160 to which the plurality of rotation mechanisms (the bucket cylinder 308, the tilt cylinder 309, and the rotary motor 310) and the bucket 164 are connected.

Another Embodiment

The embodiments have been described above in detail with reference to the drawings; however, the specific configurations are not limited to the above-described configurations, and various design changes or the like can be made. That is, in another embodiment, the order of the above-described processing may be appropriately changed. In addition, some of the processing may be executed in parallel.

The control device 200 according to the above-described embodiment may be configured by a single computer, or the configuration of the control device 200 may be arranged to be divided into a plurality of computers, and the plurality of computers may function as the control device 200 by cooperating with each other. In this case, a part of the computers configuring the control device 200 may be mounted inside the work machine, and another computer may be provided outside the work machine. For example, in another embodiment, the operation device 271 and the monitor device 272 are provided remotely from the work machine 100, and the configuration other than the measured value acquisition unit 214 and the control signal output unit 218 in the control device 200 may be provided in the remote server.

Further, the work machine 100 according to the above-described embodiment is a hydraulic excavator, but is not limited to this. For example, the work machine 100 according to another embodiment may be a work machine that is fixed on the ground and does not self-travel. Further, the work machine 100 according to another embodiment may be a work machine that does not have a swing body.

The work machine 100 according to the above-described embodiment includes the bucket 164 as the attachment of the work equipment 160, but is not limited thereto. For example, the work machine 100 according to another embodiment may include a breaker, a fork, a grapple, and the like as an attachment. Even in this case, similarly to the bucket coordinate system, the control device 200 controls the tilt rotator 163 by the local coordinate system composed of the $X_{bk}$ axis extending in the direction where the teeth of the attachment face, the $Y_{bk}$ axis extending in the direction along the teeth, and the $Z_{bk}$ axis that is orthogonal to the $X_{bk}$ axis and the $Y_{bk}$ axis.

In addition, in another embodiment, the axes of the tilt rotator 163 may not be orthogonal to each other as long as the axes intersect each other on different planes. Specifically, regarding an axis AX1 related to a joint shaft connecting the arm 162 and the attachment portion 1631, an axis AX2 related to a joint shaft connecting the attachment portion 1631 and the tilt portion 1632, and a rotation axis AX3 of the rotary motor 310, when the tilt angle and the rotation angle of the tilt rotator 163 are zero, a surface parallel to the axis AX1 and the axis AX2, a surface parallel to the axis AX2 and the axis AX3, and a surface parallel to the axis AX3 and the axis AX1 may be different from each other.

Further, the control device 200 according to another embodiment may not have a design surface setting function. Also in this case, the control device 200 can automatically control the tilt rotator 163 by performing the bucket posture holding control. For example, the operator can perform simple ground leveling work without setting the design surface.

INDUSTRIAL APPLICABILITY

According to the above aspect, in the work machine including the work tool supported by the work equipment via the tilt rotator, an operation of rotating the work tool along a reference direction (for example, an opening direction of the bucket) can be simplified.

What is claimed is:

1. A system for controlling a work machine including a tilt rotator attached to a distal end of work equipment, and a work tool supported to be rotatable around three axes intersecting with each other in different planes with respect to the work equipment via the tilt rotator, the system comprising:

a processor, wherein the processor is configured to:

acquire measured values from a plurality of sensors;

calculate a current posture of the work tool, based on the measured values;

determine a virtual rotation axis, based on the calculated current posture of the work tool;

generate a control signal of the tilt rotator for rotating the work tool around the virtual rotation axis, based on an operation signal from an operation device; and output the generated control signal, wherein the work tool has teeth, and wherein the virtual rotation axis is an axis orthogonal to a direction in which the teeth of the work tool faces and extending along the teeth of the work tool.

2. The system according to claim 1, wherein the processor is configured to:

calculate a rotation amount around the three axes such that the work tool is rotated around the virtual rotation axis by an amount corresponding to an operation amount indicated by the operation signal; and generate a control signal of the tilt rotator, based on the rotation amount around the three axes.

3. The system according to claim 1, wherein the virtual rotation axis is different from a joint shaft of the tilt rotator.

4. A non-transitory computer-readable storage medium storing a program causing a computer of a control system for a work machine including a tilt rotator attached to a distal end of work equipment, and a work tool supported to be rotatable around three axes intersecting with each other in different planes with respect to the work equipment via the tilt rotator to execute:

acquiring measured values from a plurality of sensors;

determining a current posture of the work equipment, based on the measured values;

determining a virtual rotation axis determined corresponding to a reference direction of the work tool, based on the determined current posture;

generating a control signal of the tilt rotator for rotating the work tool around the virtual rotation axis, based on an operation signal from an operation device; and outputting the generated control signal, wherein the work tool has teeth, and wherein the virtual rotation axis is an axis orthogonal to a direction in which the teeth of the work tool faces and extending along the teeth of the work tool.

5. A method for controlling a work machine including a tilt rotator attached to a distal end of work equipment, and a work tool supported to be rotatable around three axes intersecting with each other in different planes with respect to the work equipment via the tilt rotator, the method comprising:

acquiring measured values from a plurality of sensors;

determining a current posture of the work equipment, based on the measured values;

determining a virtual rotation axis determined corresponding to a reference direction of the work tool, based on the determined current posture;

generating a control signal of the tilt rotator for rotating the work tool around the virtual rotation axis, based on an operation signal from an operation device; and outputting the generated control signal, wherein the work tool has teeth, and wherein the virtual rotation axis is an axis orthogonal to a direction in which the teeth of the work tool faces and extending along the teeth of the work tool.

* * * * *